US008105132B2

(12) United States Patent
Roehm et al.

(10) Patent No.: US 8,105,132 B2
(45) Date of Patent: Jan. 31, 2012

(54) ECCENTRIC GRINDER

(75) Inventors: Heiko Roehm, Stuttgart (DE); Andreas Heber, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 624 days.

(21) Appl. No.: 12/298,381

(22) PCT Filed: Oct. 30, 2007

(86) PCT No.: PCT/EP2007/061696

§ 371 (c)(1),
(2), (4) Date: Oct. 24, 2008

(87) PCT Pub. No.: WO2008/080665

PCT Pub. Date: Jul. 10, 2008

(65) Prior Publication Data

US 2010/0062695 A1 Mar. 11, 2010

(30) Foreign Application Priority Data

Dec. 27, 2006 (DE) ..... 10 2006 061 634

(51) Int. Cl.
*B24B 23/00* (2006.01)

(52) U.S. Cl. ..... 451/357; 451/359; 451/353

(58) Field of Classification Search ..... 451/353, 451/357, 359, 63, 548, 441, 360, 533, 534, 451/537

See application file for complete search history.

(56) References Cited

U.S. PATENT DOCUMENTS

| | | | | | |
|---|---|---|---|---|---|
| 1,779,682 | A * | 10/1930 | Stratford | 451/511 |
| 5,018,314 | A | 5/1991 | Fushiya et al. | |
| 5,237,781 | A * | 8/1993 | Demetrius | 451/456 |
| 5,261,190 | A | 11/1993 | Berger et al. | |
| 5,679,066 | A * | 10/1997 | Butz et al. | 451/357 |
| 5,807,169 | A * | 9/1998 | Martin et al. | 451/357 |
| 6,059,644 | A * | 5/2000 | Manor et al. | 451/490 |
| 6,394,884 | B1 * | 5/2002 | Wuensch | 451/357 |
| 6,503,133 | B2 * | 1/2003 | Wuensch | 451/357 |
| 6,527,631 | B2 * | 3/2003 | Wuensch et al. | 451/357 |
| 6,857,949 | B2 * | 2/2005 | Reich et al. | 451/357 |
| 7,094,138 | B2 * | 8/2006 | Chang | 451/359 |
| 7,357,701 | B2 * | 4/2008 | Gautier et al. | 451/359 |
| 2002/0106982 | A1 | 8/2002 | Wuensch | |
| 2010/0062695 | A1 * | 3/2010 | Roehm et al. | 451/357 |

FOREIGN PATENT DOCUMENTS

| | | |
|---|---|---|
| DE | 39 06 549 | 9/1990 |
| DE | 101 48 339 | 4/2003 |
| FR | 2 810 914 | 1/2002 |
| GB | 2 376 651 | 12/2002 |

* cited by examiner

*Primary Examiner* — George Nguyen
(74) *Attorney, Agent, or Firm* — Michael J. Striker

(57) ABSTRACT

An eccentric grinder has a drive which is arranged in a housing and the drive shaft of which drives a supporting shaft of a back-up pad by way of an eccentric mounting. Also provided is a friction braking device, which comprises a friction braking element on the housing and a friction surface on the back-up pad. The friction surface slopes down in the radial direction from the inside to the outside with respect to a horizontal plane that is perpendicular to the axis of rotation of the back-up pad.

6 Claims, 2 Drawing Sheets

ECCENTRIC GRINDER

Figure 1:
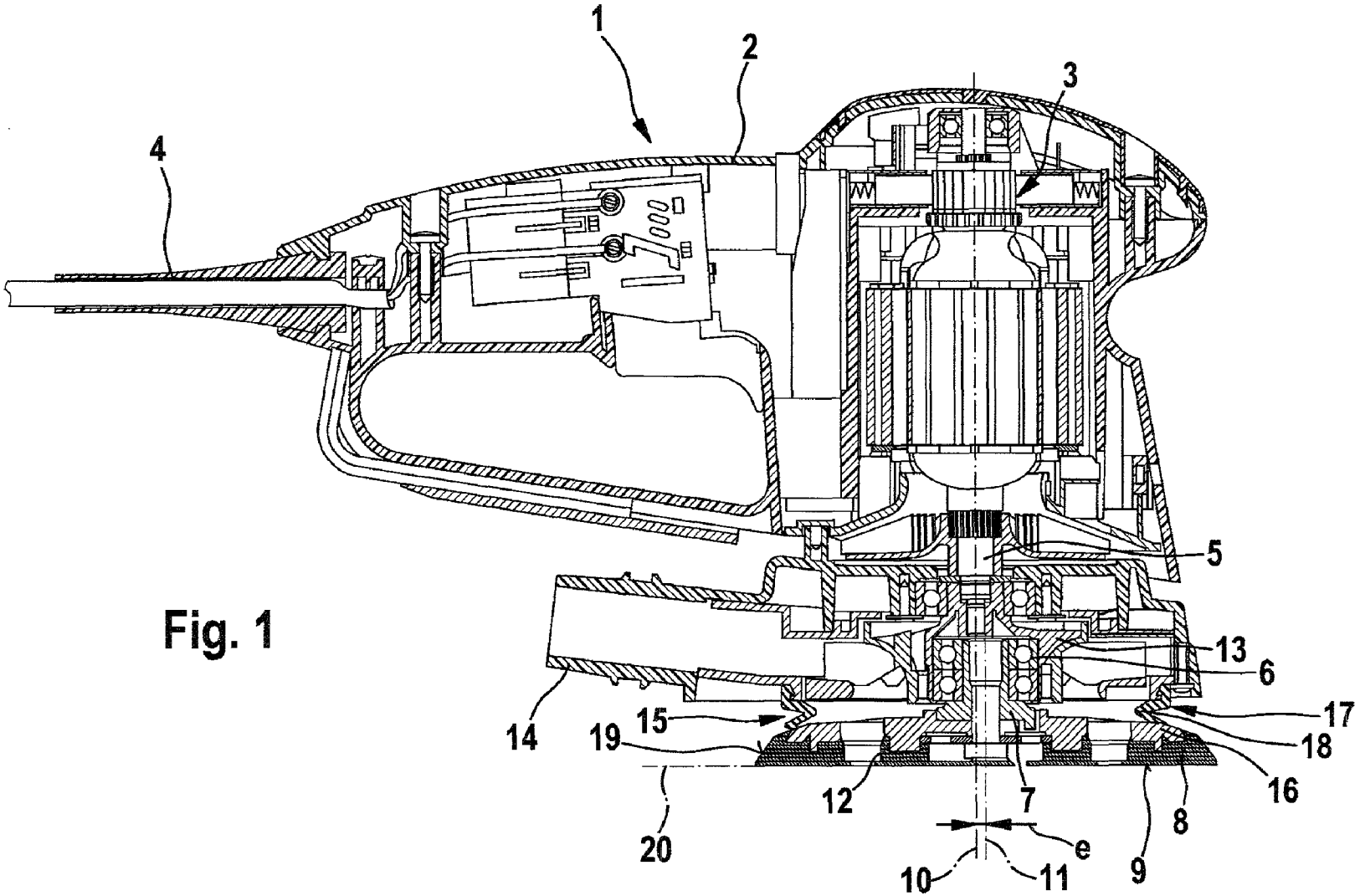

The present invention is directed to an eccentric grinder according to the preamble of Claim 1.

BACKGROUND INFORMATION

DE 39 06 549 C2 describes an eccentric grinder that includes an electric drive motor in a housing, the drive shaft of which drives a support shaft of a grinding plate—on the underside of which grinding means are to be attached—via an eccentric support. Via the eccentric support of the support shaft, a superposed circular and rotary working motion of the grinding plate—and the grinding means attached thereto—is attained. In the working position, the grinding plate and the grinding means are pressed against the surface of the workpiece to be worked. Due to the support of the support shaft on the drive shaft, the grinding plate may rotate around its own axis only under certain conditions. When the eccentric grinder idles, however, i.e., when the grinding plate is lifted away from the workpiece to be worked, there is a risk that the grinding plate will begin to rotate at the rotational speed of the drive shaft, due to the bearing friction.

To limit the self-rotation of the grinding plate when the eccentric grinder idles, a friction brake is provided, which includes interacting frictional elements on the grinding plate and on the underside—which faces the grinding plate—of the housing of the eccentric grinder. With the friction brake, when the eccentric grinder idles, an outwardly lying rolling rim on the grinding plate may walk around an inwardly located, associated rolling rim on the housing, in which case self-rotation of the grinding disk is not prevented, but the rotational speed of the grinding disk may be reduced—as compared with the rotational speed of the motor—given that the outer rolling rim and the inner rolling rim are separated. Self-rotation is not entirely prevented in this embodiment, however.

DISCLOSURE OF THE INVENTION

The object of the present invention is to design a generic eccentric grinder in such a manner that the self-rotation of the grinding plate is prevented when the eccentric grinding idles, while minimizing the wear on the friction brake.

This object is achieved according to the present invention via the features of Claim 1. The subclaims describe advantageous refinements.

The eccentric grinder includes a drive in a housing, typically an electric drive. Within the framework of the present invention, it is also possible to use a hydraulic or pneumatic drive, the drive shaft of which drives a support shaft of a grinding plate via an eccentric bearing. Grinding means, e.g., sandpaper, may be attached to the underside of the grinding plate, which is placed on the surface of a workpiece in order to work the surface. Due to the support of the support shaft—on which the grinding plate is mounted—in the drive shaft, an eccentric motion is expediently transferred to the grinding plate. Due to the grinding forces that act on the grinding plate, however, self-rotation of the grinding plate, which is basically made possible by the bearing of the support shaft, is possible during the grinding operation only under certain circumstances.

To prevent the grinding plate from running up to the rotational speed of the drive motor—due to the bearing friction—when the eccentric grinder idles, i.e., after the grinding plate has been lifted away from the work piece to be worked, a friction braking device is provided that prevents or at least brakes the self-rotation of the grinding plate during idle. This friction brake device includes a friction braking element, which is located on the housing of the eccentric grinder, and an assigned frictional surface on the grinding plate, which is acted upon with a frictional force by the friction braking element. The frictional surface of the grinding plate slopes downward in the radial direction, from the inside to the outside, relative to a horizontal plane, which is perpendicular to the axis of the support shaft. This means that the frictional surface—which faces the housing—on the grinding plate has the highest—relative to the horizontal plane—raised area in the region of the rotation axis, while the frictional surface slopes downward toward the radially outwardly lying edge of the grinding plate.

This embodiment has the advantage that the side of the grinding plate that is currently deflected eccentrically is acted upon by the friction element to a greater extent than the diametrically opposed side of the grinding plate, since, given that the course of the friction surface rises toward the center of the grinding plate, the friction braking element has less clearance from the friction braking element on the deflected side, and therefore comes in frictional contact sooner and/or more intensively than it does on the opposite side. The self-rotation of the grinding plate is therefore effectively inhibited, since the friction element exerts a frictional force on the friction surface on the eccentrically deflected side. A stabilizing effect is also attained, which results from the fact that the friction element presses the grinding plate slightly downward on the eccentrically deflected side, thereby moving the grinding plate back into its normal working position, with the axis of the support shaft parallel to the drive shaft. Without a stabilizing friction braking element, however, there is a risk that the grinding plate may tilt away from the normal of the drive shafts due to the eccentric drive and the bearing play, thereby increasing the bearing friction and possibly resulting in a run-up of the self-rotation of the grinding plate. This effect may be prevented or at least greatly reduced with the aid of the embodiment according to the present invention.

In principle, the friction surface on the grinding plate may have any cross-sectional geometry, provided it is ensured that the friction surface slopes downward toward the outer edge of the grinding plate. In a particularly advantageous embodiment, the friction surface is conical in design and has a taper angle of at least 5°, which is particularly easy to realize in terms of design. As an alternative, a non-conical shape is also possible, in particular a shape with a fluctuating slope as viewed in the radial direction of the grinding plate, relative to the horizontal plane, which is perpendicular to the rotation axis of the grinding plate. Mathematically speaking, one possibility is a strictly monotonously decreasing slope, or simply a monotonously decreasing slope of the friction surface, i.e., a shape with falling sections and horizontal sections. It is also feasible to provide intermediate sections in the friction surface that have a shape that rises toward the radially outwardly lying edge, provided that the friction surface is guaranteed to have a downward slope in the middle, between the rotation axis of the grinding plate and its outer edge.

The friction braking element is expediently designed as a friction ring, which advantageously has a cross section that is uniform in the circumferential direction. To support and improve a resilient behavior of the friction braking element, it may be expedient to provide a compensating section—the length of which is expandable—in the cross section of the friction braking element. This compensating section, which has a V-shaped cross section, for example, permits a behavior with elastic spring action in the friction braking element to be transferred in the direction of the friction braking force, thereby also making it possible to compensate for fluctuations in the grinding plate during rotation.

According to an advantageous embodiment, the friction surface may be designed as a separate contact component that is connected with the grinding plate. The advantage of designing it as a separate component is that the friction surface may be composed of a different material than that of the grinding plate. Various plastics may be used as the materials for the friction surface, e.g., polyamide, polypropylene, polycarbonate, or PMMA. As an alternative, the friction surface may also be composed of metal, in particular of aluminum or magnesium, or a foamed material.

Further advantages and advantageous embodiments are depicted in the further claims, the description of the figures, and the drawing.

Figure 2:
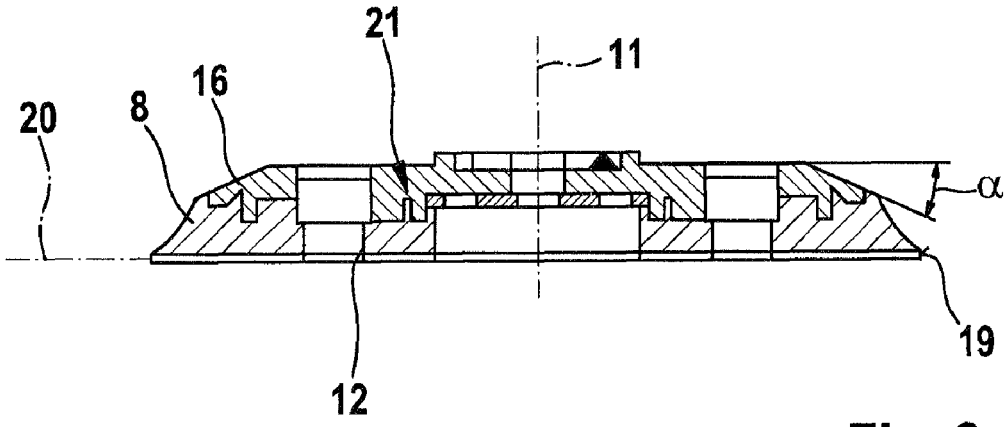
Figure 3:
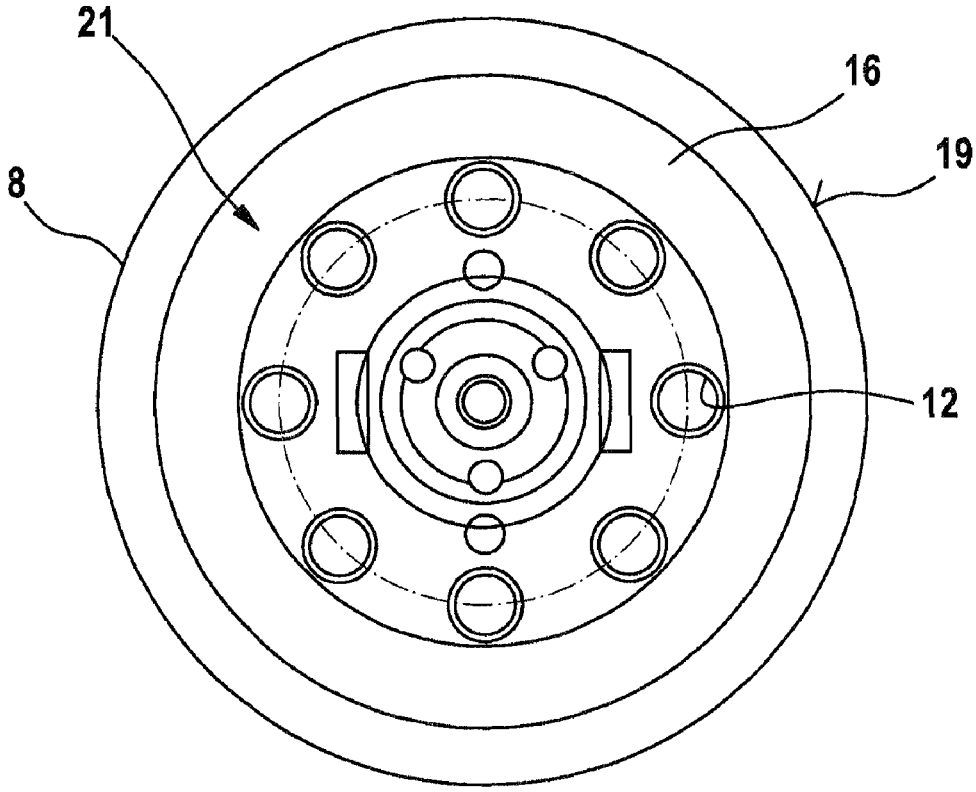

FIG. 1 shows a sectional view of an eccentric grinder, the grinding plate of which is eccentrically driven, the side of the grinding plate facing the housing of the eccentric grinder including a friction surface against which a friction braking element bears, the friction surface having a slope that slants downward in a conical manner toward the edge, FIG. 2 shows an isolated view of the grinding plate, FIG. 3 shows a top view of the grinding plate.

Components that are the same are labelled with the same reference numerals in the figures.

Eccentric grinder 1 shown in FIG. 1 includes an electric drive motor 3 in a housing 2, electric drive motor 3 being supplied with electric current via a power supply 4. A support shaft 7 is supported on a drive shaft 5 of drive motor 3 via an eccentrically situated bearing. Support shaft 7 carries a grinding plate 8, on whose underside 9 a grinding means is to be attached for working the surface of a work piece. Bearing 6 is designed, e.g., as a ball bearing, and allows self-rotation of support shaft 7 about rotation axis 11, which is also the rotation axis of grinding plate 8. Rotation axis 11 is situated in parallel with rotation axis 10 of drive shaft 5, at an eccentric distance e.

Holes 12 are provided around the circumference of grinding plate 8, via which grinding dust that is produced when the work piece is machined is suctioned into the housing with the aid of a dust and/or motor fan 13. Dust fan 13 is fixedly connected with drive shaft 5 of the drive motor and includes an eccentrically designed, pot-shaped chamber in which bearing 6 for supporting support shaft 7 is accommodated. The grinding dust transported through holes 12 is directed via a blow-out connector 14 located on the housing side into a dust-collection container, which is not depicted.

To prevent self-rotation of the grinding plate about rotation axis 11 during idle, i.e., when grinding plate 8 has been lifted away from the work piece to be worked—the self-rotation being brought about by bearing friction in bearing 6—, a friction brake device 15 is provided between housing 2 and grinding plate 8, which prevents or at least brakes the self-rotation of the grinding plate. Friction brake device 15 includes a friction surface 16 on the grinding plate on the top side, which is assigned to housing 2, and a friction brake element 17, which is fixedly connected with housing 2 and enters into frictional contact with friction surface 16. Friction braking element 17 is expediently designed as a friction ring and is composed of rubber or an elastomeric material, e.g., TPE, EPDM, or NBR. In the cross-sectional view, friction ring 17 has an approximately V-shaped compensating section 18, which allows the friction ring to expand and contract longitudinally in an elastic manner in the direction in which the frictional force is applied.

Friction surface 16 on the top side of grinding plate 8 has a cross-sectional shape that slopes downward, as viewed radially from the inside toward the outside, i.e., from rotation axis 11 in the direction toward the radially outwardly lying edge 19 of the grinding plate. This downward slope is relative to a horizontal plane 20, which is perpendicular to rotation axis 11 of sanding plate 8.

When the eccentric grinder idles, grinding plate 8 is tilted slightly out of its position with parallel rotation axes, due to bearing play and the eccentric drive. Rotation axis 11 of the grinding plate is therefore slanted relative to rotation axis 10 of drive shaft 5. The side of the grinding plate that is currently eccentrically deflected is raised slightly, thereby bringing the friction surface at this point in contact with friction braking element 17 and imparting a friction force upon it, which brakes the self-rotation of grinding plate 8. In addition, friction braking element 17 presses the slightly raised grinding plate back downward into a position with a rotation axis that is parallel to rotation axis 10 of the drive shaft.

Due to the shape of the cross section of frictional surface 16, which rises radially from the outside toward the inside, the side that is currently eccentrically deflected comes in greater frictional contact with friction braking element 17 than the diametrically opposed side. As a result, the grinding plate experiences a greater braking force on the eccentrically deflected side than it does on the diametrically-opposed side.

Taper angle $\alpha$ shown in the isolated depiction in FIG. 2 is the angle at which the conical section of friction surface 16 is slanted relative to the horizontal plane and/or a plane that is parallel thereto. In the exemplary embodiment shown in FIG. 2, the conical section of friction surface 16 is limited to a region that lies relatively far to the outside in the radial direction. The essential point is that the friction surface has a downward slope toward the outside in the radial direction, starting from rotation axis 11, as viewed along its entire radial extension.

As also shown in FIG. 2, friction surface 16 is part of a contact component 21, which is designed separately from grinding plate 8, but which is connected thereto and forms the top side of the grinding plate, which faces housing 2. This makes it possible to manufacture friction surface 16 out of a different material than grinding plate 8.

As shown in FIG. 2 and FIG. 3, it may be advantageous for friction surface 16 to not extend to outer edge 19 of grinding plate 8, but rather for it to be set back relative to outer edge 19, as viewed in the radial direction. This is basically sufficient to ensure that the friction braking element acts on the grinding plate with a frictional force when in the eccentrically deflected position.

What is claimed is:

1. An eccentric grinder, with a drive (3) located in a housing (2), the drive shaft (5) of which drives a support shaft (7) of a grinding plate (8) via an eccentric bearing (6), a friction braking device (15) comprising a friction braking element (17) located on the housing (2), designed as a friction ring, and a friction surface (16) on the grinding plate (8), wherein the friction surface (16) is conical in design and configured to be acted upon with a frictional force by the friction braking element (17), wherein the friction surface (16) is located on a contact component (21), which contact component (21) is designed to be separate from but connected to the grinding plate (8), and made of a different material than the grinding plate (8), and wherein the friction surface (16) is arranged on the grinding plate (8) to slope downward in a radial direction, from the inside to the outside, relative to a horizontal plane (20), which is perpendicular to the rotation axis (11) of the grinding plate (8) thereby forming a taper angle ($\alpha$) of at least 5° relative to the horizontal plane (20).

2. The eccentric grinder as recited in claim 1, wherein the friction braking element (17) is designed to have elastic spring action.

3. The eccentric grinder as recited in claim 1, wherein the friction braking element (17) includes a compensation section (18), the length of which is expandable and/or compressible in the direction of the application of the frictional force.

4. The eccentric grinder as recited in claim 1, wherein the frictional surface (16) is made of plastic, e.g., polyamide (PA), polypropylene (PP), polycarbonate (PC), or polymethyl methacrylate (PMMA).

5. The eccentric grinder as recited in claim 1, wherein the frictional surface (16) is composed of metal, in particular of aluminum or magnesium.

6. The eccentric grinder as recited in claim 1, wherein the frictional surface (16) is composed of a foamed material.

* * * * *